US005095621A

United States Patent [19]

Rapp

[11] Patent Number: 5,095,621

[45] Date of Patent: Mar. 17, 1992

[54] RAZOR COVER

[76] Inventor: Alan D. Rapp, 4807 Avondale Cir., Colorado Springs, Colo. 80917

[21] Appl. No.: 688,314

[22] Filed: Apr. 22, 1991

[51] Int. Cl.[5] ..... B26B 21/40; B26B 19/38

[52] U.S. Cl. ..... 30/90; 30/164

[58] Field of Search ..... 30/90, 164, 340, 346

[56] References Cited

U.S. PATENT DOCUMENTS

| | | | |
|---|---|---|---|
| 3,396,465 | 8/1968 | Knight et al. | 30/90 |
| 3,399,455 | 9/1968 | Steere, Jr. | 30/90 |
| 3,408,737 | 11/1968 | Steere, Jr. et al. | 30/90 |
| 3,530,574 | 9/1970 | Patterson | 30/90 |
| 3,576,071 | 4/1971 | Eriksen | 30/90 |
| 4,587,730 | 5/1986 | Iten | 30/90 |

*Primary Examiner*—Douglas D. Watts
*Assistant Examiner*—Paul M. Heyrama
*Attorney, Agent, or Firm*—Richard W. Hanes

[57] ABSTRACT

A cover to protect the head portion of a safety razor, the razor having at least one blade edge in said head portion, a handle, and a shank portion normally connecting the handle to the head portion, the cover comprising a generally tubular-shaped portion, and an aperture in said tubular-shaped portion to accommodate the shank portion of a razor to be protected. The razor cover has first and second open ends and an open slit from one open end to the aperture to allow the cover to slide on the head portion of the razor to be covered. The cover is also disclosed in combination with a safety razor.

10 Claims, 1 Drawing Sheet

RAZOR COVER

BACKGROUND OF THE INVENTION

The invention relates to a cover for the blade carrying head portion of a safety-type razor. In the past, such covers have been formed of rigidly molded plastic and have been configured to conform to the particular razor type are designed to cover. Thus, each cover is designed to clip on only one particular type or brand of safety razor. Such covers rarely cover the entire head of the razor and thus can frequently become dislodged and loose from the blade portion. Separated from the razor, such covers frequently are dropped and damaged.

Elaborate and expensive cases for safety razors are also well known. Such cases are designed to enclose the entire razor, including the blade, head, and handle portions. Such cases can be cumbersome and heavy when traveling, as well as expensive to purchase.

OBJECTS OF THE INVENTION

It is an object of the invention to provide a cover for the head of a safety razor which is lightweight and inexpensive to make.

It is a further object of the invention to provide a cover for the head portion of a safety razor which is sturdy in design and resists being broken or crushed on or off the razor to be protected.

Another object of the invention is to provide a cover for the head portion of a safety razor which can fit various types and configurations of safety razors.

It is a further object of the invention to provide a cover for the head portion of a safety razor which can be secured on the razor to resist accidental removal.

The invention comprises a cover to protect the head portion of a safety razor. The razor is of the type having a handle, a blade carrying head portion, and a shank portion for attaching said handle to said head portion. The cover comprises a generally tubular-shaped portion having first and second open ends. A rectangular aperture is located between said open ends to accommodate the shank portion of the razor to be protected. An open slit extends from one of the open ends to the aperture to allow the cover to slide on the head portion of the razor to be protected. The invention also contemplates the cover in combination with the razor to be protected.

DETAILED DESCRIPTION OF THE DRAWING

Although the invention is described with reference to a single blade, single-edge razor, it is noted that the cover could be sized to accommodate other types of razors such as those of the double-edged type.

Figure 1:
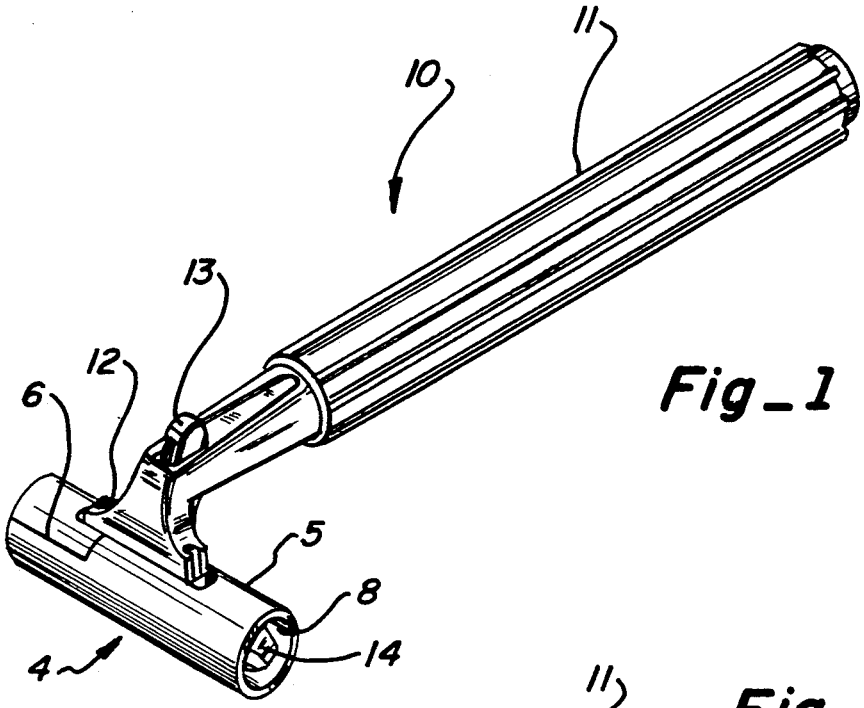
FIG. 1 is a perspective view of the combination of the instant invention showing the cover on the head portion of a razor to be protected.

FIG. 1 shows the cover 4 on the razor 10 to be protected. The razor includes a handle 11, and a head portion 14 as is well known. A shank portion 12 attaches the handle 11 to the head portion 14. At least one blade 15 (shown in FIG. 3) is carried by the head portion 14 as is well known. A release to detach head portion 14 from the handle 11 is shown at 13, as is also well known.

Figure 2:
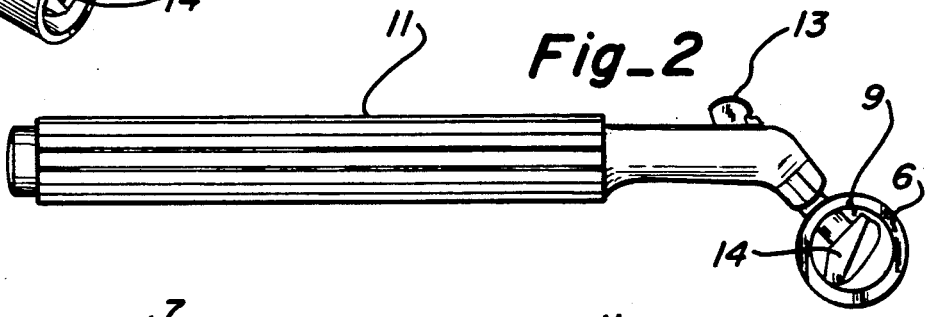
FIG. 2 is a side view of the cover in combination with the razor and head to be protected.
Figure 4:
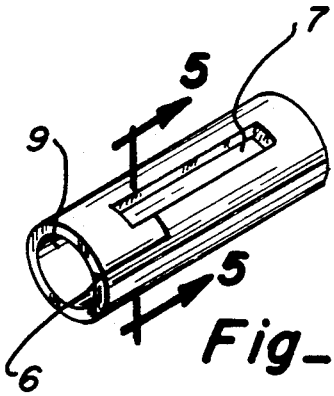
FIG. 4 is a perspective view of the cover of the instant invention.
Figure 5:
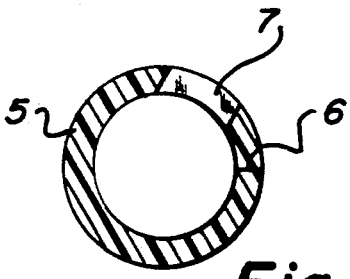
FIG. 5 is a cross-sectional view taken along line 5—5 of FIG. 4.

The cover 4 includes a generally tubular-shaped body portion 5 formed of a flexible or resilient plasticized material such as extruded polyvinyl chloride. The cover has an opened portion 8 or 9 at each end of its tubular-shaped body portion (see FIGS. 1 and 2). The open ends 8 and 9 allow the head portion 14 of the razor to air dry after use, if desired. An open slit 6 (FIG. 4) extends from open end 9 to a rectangular aperture 7 (FIGS. 4 and 5) in the tubular-shaped body portion. The aperture 7 is preferably located generally equidistant from the open ends 8 and 9 to best cover the razor 10.

Figure 3:
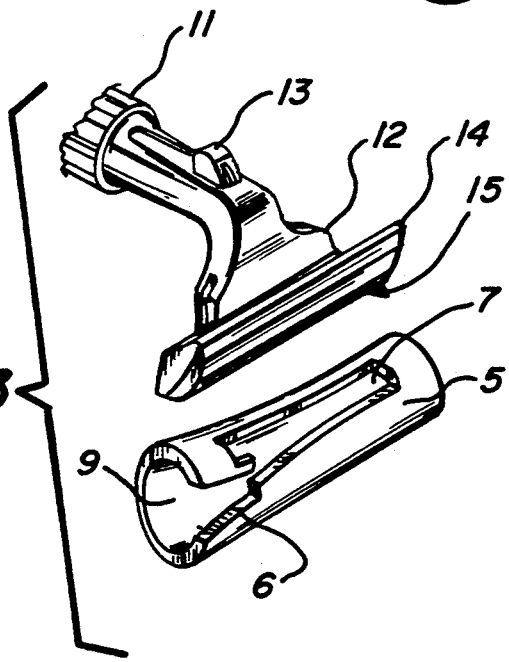
FIG. 3 is an exploded view of the razor to be protected along with the cover of the instant invention showing the cover in its flexed position.

As shown in FIG. 3, the flexible plasticized material allows the cover 5 to flex for ease of insertion on the head portion 14 of the razor. In operation, when the razor is to be stored, the user slides the cover 4 on the head portion 14 of the razor until slit 6 engages shank portion 12. The cover 4 then flexes to allow the shank portion 12 to move along slit 6 and come to rest in aperture 7. The cover flexes again due to the resilient nature of the material to close slit 6 as shown in FIG. 1. The cover is the secure on the razor to be protected.

Although the cover of the instant invention has been described as being formed of extruded polyvinyl chloride, it is noted that other well known resilient materials, such as cured rubber compounds, could also be used.

I claim:

1. A cover to protect the head portion of a safety razor, said razor having at least one blade edge in said head portion, a handle, and a shank portion normally connecting said handle to said head portion, said cover comprising a body portion having first and second open ends, an aperture in said body portion to accommodate the shank portion of a razor to be protected, and a slit from one of said ends to said aperture, said cover being movable from a first position to allow said shank portion to slide along said slit to said aperture, to a second position to close said slit and to receive said cover on the razor.

2. The cover of claim 1 wherein said body portion is tubular in shape.

3. The cover of claim 2 wherein said aperture is in a wall of said tubular-shaped body portion between said ends.

4. The cover of claim 3 wherein said aperture is generally rectangular in shape and located approximately equidistant from each of said ends.

5. The cover of claim 1 wherein said cover is formed of flexible extruded plasticized material.

6. In combination, a safety-type razor comprising a handle, a head portion, at least one blade carried by said head portion, a shank portion for connecting said handle to said head portion, and a cover to protect the head portion of said razor, said cover comprising a body portion having first and second open ends, an aperture in said body portion to accommodate said shank portion of said razor, and a slit from one of said ends to said aperture, said cover being movable from a first position to allow said shank portion to slide along said slit to said aperture, to a second position to close said slit and to secure said cover on the razor.

7. The cover of claim 6 wherein said body portion is tubular in shape.

8. The cover of claim 7 wherein said aperture is in a wall of said tubular-shaped body portion between said ends.

9. The cover of claim 8 wherein said aperture is generally rectangular in shape and located approximately equidistant from each of said ends.

10. The cover of claim 6 wherein said cover is formed of flexible extruded plasticized material.

* * * * *